United States Patent [19]

McCauley et al.

[11] Patent Number: 4,920,765

[45] Date of Patent: May 1, 1990

[54] REFRIGERATOR CABINET HAVING AIR FLOW CONTROL MEANS

[75] Inventors: Michael J. McCauley, Cox's Creek; David G. Beers, Louisville; John P. Raymond, Cox's Creek, all of Ky.

[73] Assignee: General Electric Company, Louisville, Ky.

[21] Appl. No.: 295,558

[22] Filed: Jan. 11, 1989

[51] Int. Cl.[5] ..... F25D 17/04

[52] U.S. Cl. ..... 62/408; 62/187; 62/441

[58] Field of Search ..... 62/187, 408, 441

[56] References Cited

U.S. PATENT DOCUMENTS

| | | | |
|---|---|---|---|
| 2,255,292 | 9/1941 | Lincoln | 257/3 |
| 2,749,833 | 6/1956 | Hekelaar | 98/95 |
| 3,020,733 | 2/1962 | Hubacker | 62/419 |
| 3,103,109 | 9/1963 | Krug et al. | 62/419 |
| 3,180,611 | 4/1965 | Wieland | 251/304 |
| 3,446,227 | 5/1969 | Grayson | 251/304 |
| 3,455,119 | 7/1969 | Bright | 62/180 |
| 3,630,046 | 12/1971 | Boor | 62/408 |
| 4,509,335 | 4/1985 | Griffin et al. | 62/77 |
| 4,642,998 | 2/1987 | Kang et al. | 62/408 |
| 4,704,874 | 11/1987 | Thompson et al. | 62/408 |

*Primary Examiner*—Ronald C. Capossela
*Attorney, Agent, or Firm*—Frederick P. Weidner; Radford M. Reams

[57] ABSTRACT

A refrigerator cabinet has a valve controlling the amount of cooled air flowing from a cooling chamber having an evaporator to a fresh food compartment to control the ratio of the air flow from the cooling chamber to a freezer compartment and the fresh food compartment. The valve is retained in a predetermined position at the time of assembly by a duct cover, which is forward of an evaporator cover in the freezer compartment, having a frangible key on its front wall extend through an opening in a disc of the valve. If a user deems the freezer compartment too hot or too cold, a service person breaks the frangible key with pliers, for example, after removing the duct cover and rotates the valve to one of a plurality of selected positions to change the air flow. The dics has a plurality of notches in its periphery for cooperation with a second key on the front wall of the duct cover to hold the valve in its selected position. The spacing of the notches on the periphery is in accordance with various rates of air flow to the fresh food compartment.

20 Claims, 9 Drawing Sheets

REFRIGERATOR CABINET HAVING AIR FLOW CONTROL MEANS

FIELD OF THE INVENTION

This invention relates to a refrigerator cabinet of a household refrigerator having a valve for controlling the ratio of cooled air flowing from an evaporator to a fresh food compartment and a freezer compartment and, more particularly, to a valve to control the amount of air flowing to the fresh food compartment so as to change the ratio of air flow from the evaporator to the freezer compartment and the fresh food compartment.

BACKGROUND OF THE INVENTION

U.S. Pat. 4,509,335 to Griffin et al has a valve controlling the amount of cooled air flowing from an evaporator into a fresh food compartment for controlling the ratio of air flow to the fresh food compartment and a freezer compartment. The valve is disposed at an outlet of a duct through which air flows from a fan after passing over the evaporator to the fresh food compartment and is manually adjustable by a user.

It has been found that the user cannot always satisfactorily obtain a desired position of the valve. Thus, it is desired to prevent a user from adjusting the valve while still having the capability of adjusting the ratio of the cooled air from the evaporator to the freezer and fresh food compartments.

SUMMARY OF THE INVENTION

The present invention satisfactorily solves the foregoing problem through providing a control valve for controlling the flow of air to the fresh food compartment to control the ratio of the air flowing from the evaporator to the freezer and fresh food compartments. The valve is disposed in a predetermined position at the time of assembly to produce the desired rate of flow of air to the fresh food compartment.

If a user complains about the temperature in the freezer compartment being too warm or too cold, a trained service person adjusts the control valve from its predetermined position to one of a plurality of selected positions to change the air flow into the fresh food compartment. This is accomplished through a duct cover being removed and means, which is holding the valve in its predetermined position, being rendered ineffective by being broken to enable rotation of the valve to one of the plurality of selected positions by the service person. The valve is held in its selected position by cooperating means on the duct cover and the valve.

The cooperating means on the duct cover and the valve for holding the valve in its selected position preferably include a plurality of notches in a periphery of a disc of the valve and a key projecting from a front wall of the duct cover for disposition in one of the notches in the periphery of the disc. When the valve is in its predetermined position, the key is in one of the notches in the periphery of the disc of the valve.

An object of this invention is to provide a refrigerator cabinet having a control valve for controlling the ratio of air flow from an evaporator to fresh food and freezer compartments of a refrigerator cabinet in which the valve is fixed in a predetermined position at assembly and adjustable to a plurality of selected positions only by a service person.

Other objects of this invention will be readily perceived from the following description, claims, and drawings.

BRIEF DESCRIPTION OF DRAWINGS

The attached drawings illustrate preferred embodiments of the invention, in which.

DESCRIPTION OF THE PREFERRED EMBODIMENTS

Figure 1:
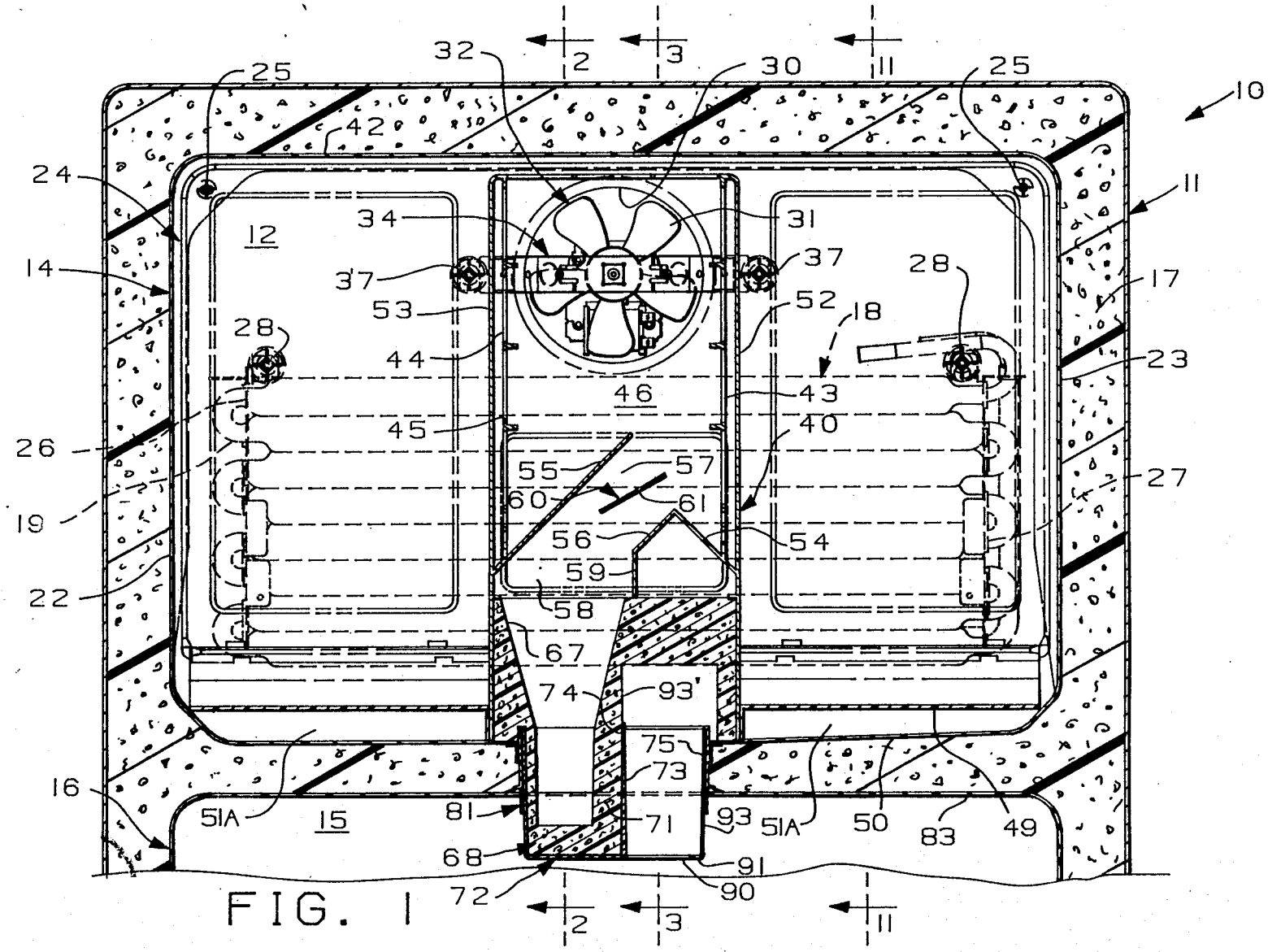
FIG. 1 is a sectional view, partly in elevation, of a portion of a household refrigerator cabinet showing one form of an air flow control valve of the present invention and taken along line 1—1 of FIG. 2.

Referring to the drawings and particularly FIG. 1, there is shown a refrigerator cabinet 10 of a household refrigerator. The refrigerator cabinet 10 includes an outer case 11 having a freezer compartment 12, which is defined by a freezer liner 14, and a fresh food compartment 15, which is defined by a fresh food liner 16. Each of the freezer liner 14 and the fresh food liner 16 is preferably a vacuum formed plastic.

Foamed thermal insulation material 17 such as urethane, for example, is disposed between the outer case 11 and the freezer liner 14, the outer case 11 and the fresh food liner 16, and the freezer liner 14 and the fresh food liner 16. The foamed thermal insulation material 17 adheres to each of the outer case 11, the freezer liner 14, and the fresh food liner 16.

Figure 2:
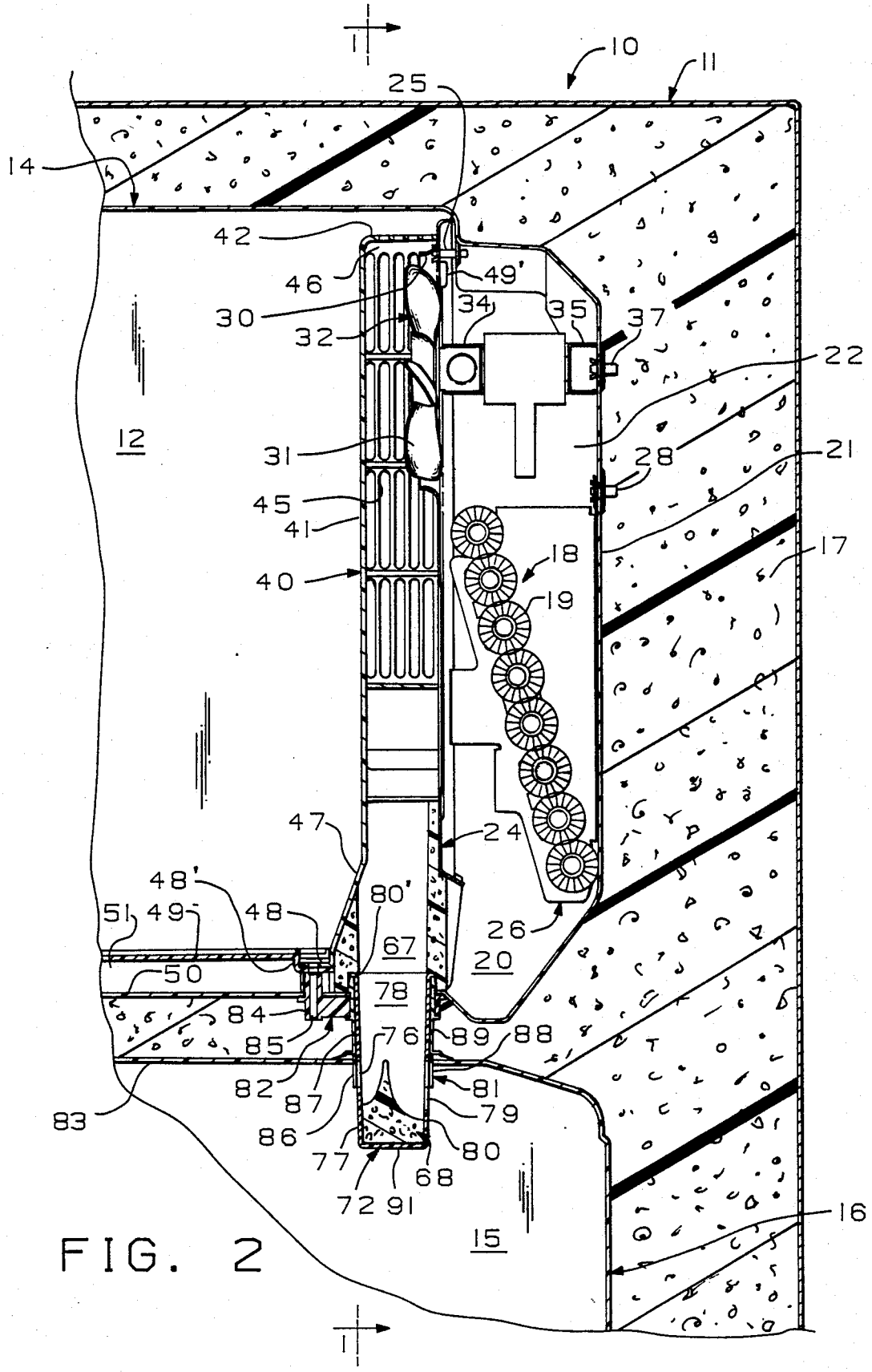
FIG. 2 is a fragmentary sectional view, partly in elevation, of a portion of the refrigerator cabinet of FIG. 1 showing a duct for supplying air to flow into a fresh food compartment and taken along line 2—2 of FIG. 1.

As shown in FIG. 2, an evaporator 18, which comprises a plurality of serially connected coils 19, is supported within a cooling chamber 20, which is defined by a rear wall 21, a left side wall 22, and a right side wall 23 (see FIG. 1) of the freezer liner 14 and an evaporator cover 24 (see FIG. 2). The evaporator cover 24 is retained in position by a pair of anchor bolts 25 extending through a slot (not shown) and a hole (not shown) in the evaporator cover 24 into the freezer liner 14. The slot enables adjustment during assembly for tolerances.

The evaporator 18 is supported between a left L-shaped support bracket 26 and a right L-shaped support bracket 27 (see FIG. 1). Each of the brackets 26 and 27 is mounted on the rear wall 21 (see FIG. 2) of the freezer liner 14 by an anchor bolt 28 extending through a slot adjacent the top of a portion of each of the brackets 26 and 27 (see FIG. 1) bearing against the inner surface of the rear wall 21 (see FIG. 2) of the freezer liner 14.

Figure 3:
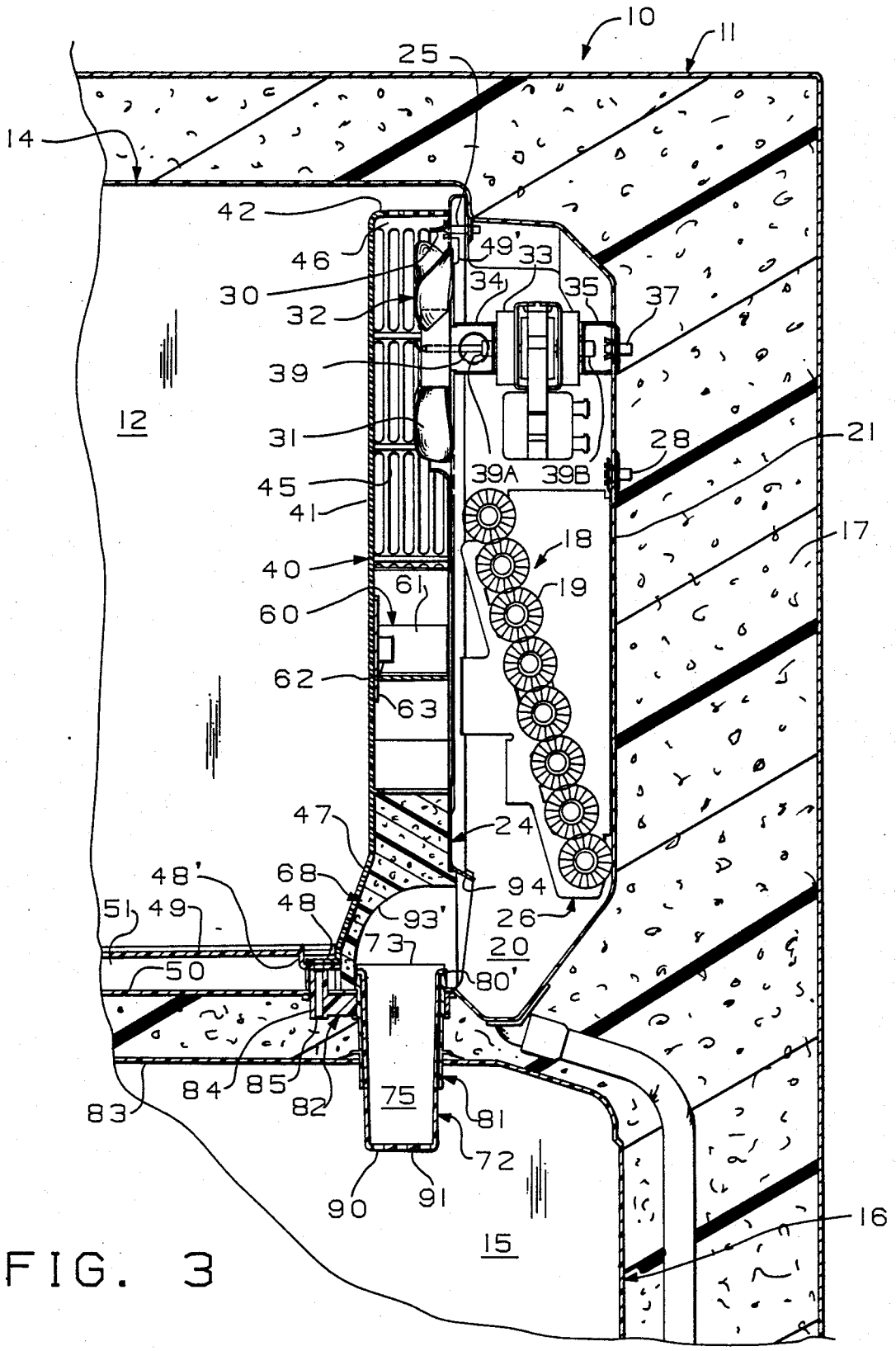
FIG. 3 is a fragmentary sectional view, partly in elevation, of a portion of the refrigerator cabinet of FIG. 1 showing a duct for returning air from the fresh food compartment and taken along line 3—3 of FIG. 1.
Figure 9:
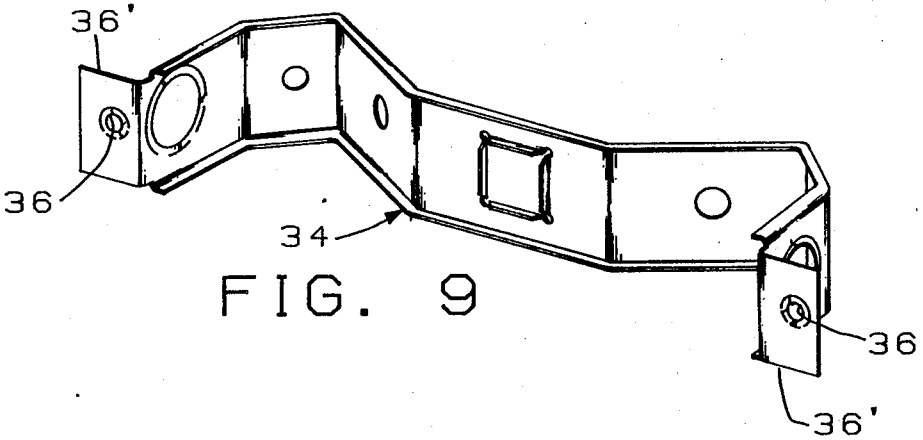
FIG. 9 is a front perspective view of a front bracket for supporting a fan for circulating air and a motor driving the fan.
Figure 10:
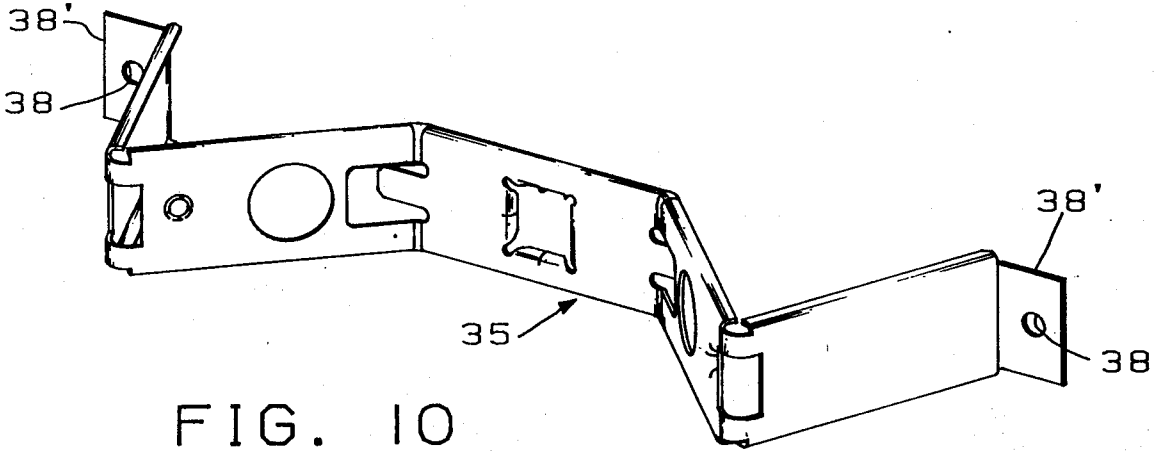
FIG. 10 is a front perspective view of a rear bracket for supporting the fan for circulating air and the motor for driving the fan.

The evaporator cover 24 has an opening 30 within which fan blades 31 of a fan 32, which is driven by a motor 33 (see FIG. 3), are disposed. The fan 32 and the motor 33 are supported by a front bracket 34 and a rear bracket 35. The front bracket 34 is attached to the evaporator cover 24 by anchor bolts (not shown) extending through holes 36 (see FIG. 9) in end portions 36' of the front bracket 34 into the evaporator cover 24 (see FIG. 3). The rear bracket 35 is secured by anchor bolts 37 extending through holes 38 (see FIG. 10) in end portions 38' of the rear bracket 35 into the rear wall 21 (see FIG. 3) of the freezer liner 14. The fan 32 has its shaft 39 rotatably supported in a collar 39A mounted on the front bracket 34 and a bearing cup 39B mounted on the rear bracket 35.

A duct cover 40 is mounted forwardly of the evaporator cover 24. The duct cover 40 includes a front wall 41, a top wall 42, and inner parallel side walls 43 (see FIG. 4) and 44. Each of the top wall 42 and the inner side walls 43 and 44 of the duct cover 40 extends rearwardly from the front wall 41 and has elongated apertures 45 therein. The apertures 45 permit the flow of air to the freezer compartment 12 (see FIGS. 2 and 3) from a chamber 46, which is formed between the front wall 41, the top wall 42, and the inner side walls 43 (see FIG. 4) and 44 of the duct cover 40 and the evaporator cover 24 (see FIGS. 2 and 3).

The front wall 41 of the duct cover 40 has an inclined forward lower portion 47, which has a pair of horizontal tabs 48 extending from its bottom edge. Each of the pair of the horizontal tabs 48 is disposed in a corresponding cup-shaped pocket 48' of a floor 49 of the freezer compartment 12. The duct cover 40 (see FIG. 4) has a tab 49' extending from the upper portion of each of the inner side walls 43 and 44 for disposition in holes in the evaporator cover 24 (see FIG. 1) to support the duct cover 40 in conjunction with the tabs 48 (see FIGS. 2 and 3).

Figure 11:
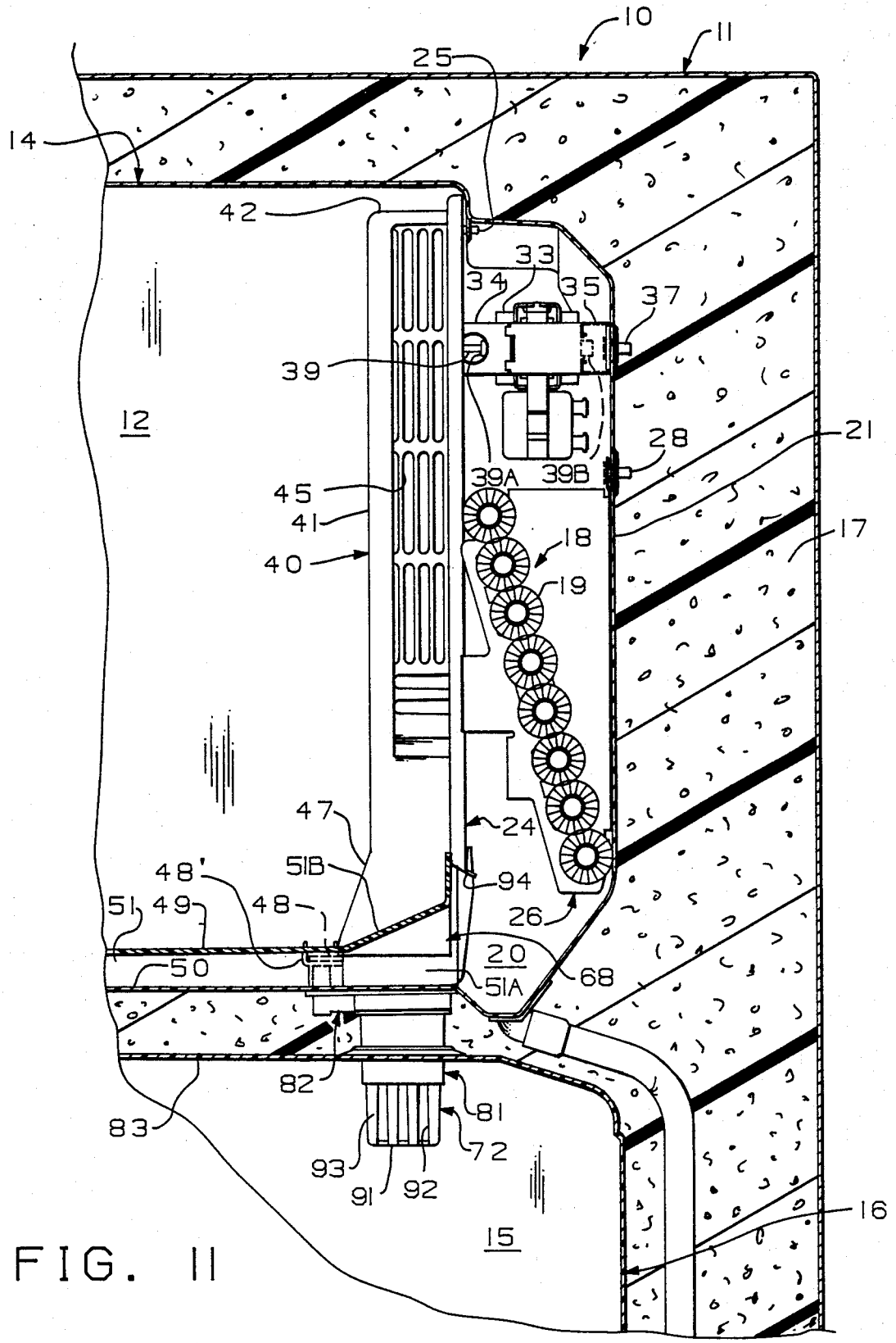
FIG. 11 is a fragmentary sectional view, partly in elevation, of a portion of the refrigerator cabinet of FIG. 1 showing a duct for returning air from the freezer compartment of the refrigerator cabinet and taken along line 11—11 of FIG. 1.

The floor 49 is spaced from a bottom wall 50 of the freezer liner 14 to provide a return air duct 51 from the freezer compartment 12 As shown in FIG. 11, the return air duct 51 communicates with the cooling chamber 20 through a pair of ducts 51A (one shown) on opposite sides of the duct cover 40. Each of the ducts 51A is formed between an inclined extension 51B of the floor 49 of the freezer compartment 12 and a portion of the bottom wall 50 of the freezer liner 14.

Figure 4:
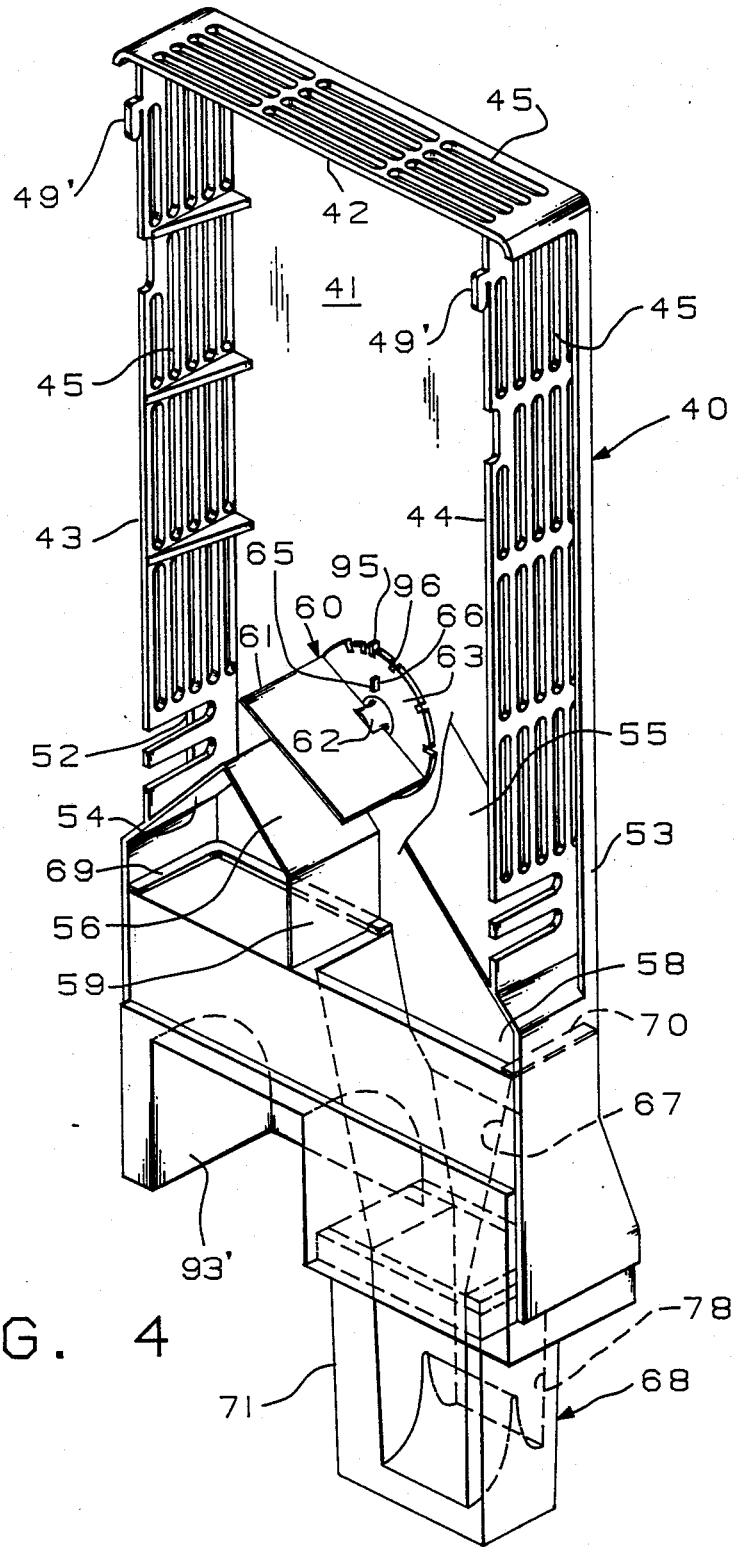
FIG. 4 is a perspective view of a duct cover and a block of FIGS. 2 and 3 and taken from the rear side of the duct cover.

The duct cover 40 (see FIG. 5) has a pair of parallel outer side walls 52 and 53, which are disposed in slightly spaced relation to the inner side walls 43 and 44 and parallel thereto. As shown in FIG. 4 for the side wall 53, each of the side walls 52 and 53 extends only a very short distance from the front wall 41 for the length of the inner side walls 43 and 44, respectively, and a slight distance beyond the bottoms of the inner side walls 43 and 44. From the intersection of the outer side wall 52 with an inclined wall 54 and the intersection of the outer side wall 53 with an inclined wall 55 to their bottoms, the outer side walls 52 and 53 extend from the front wall 41 for the same distance as the inner side walls 43 and 44.

Figure 5:
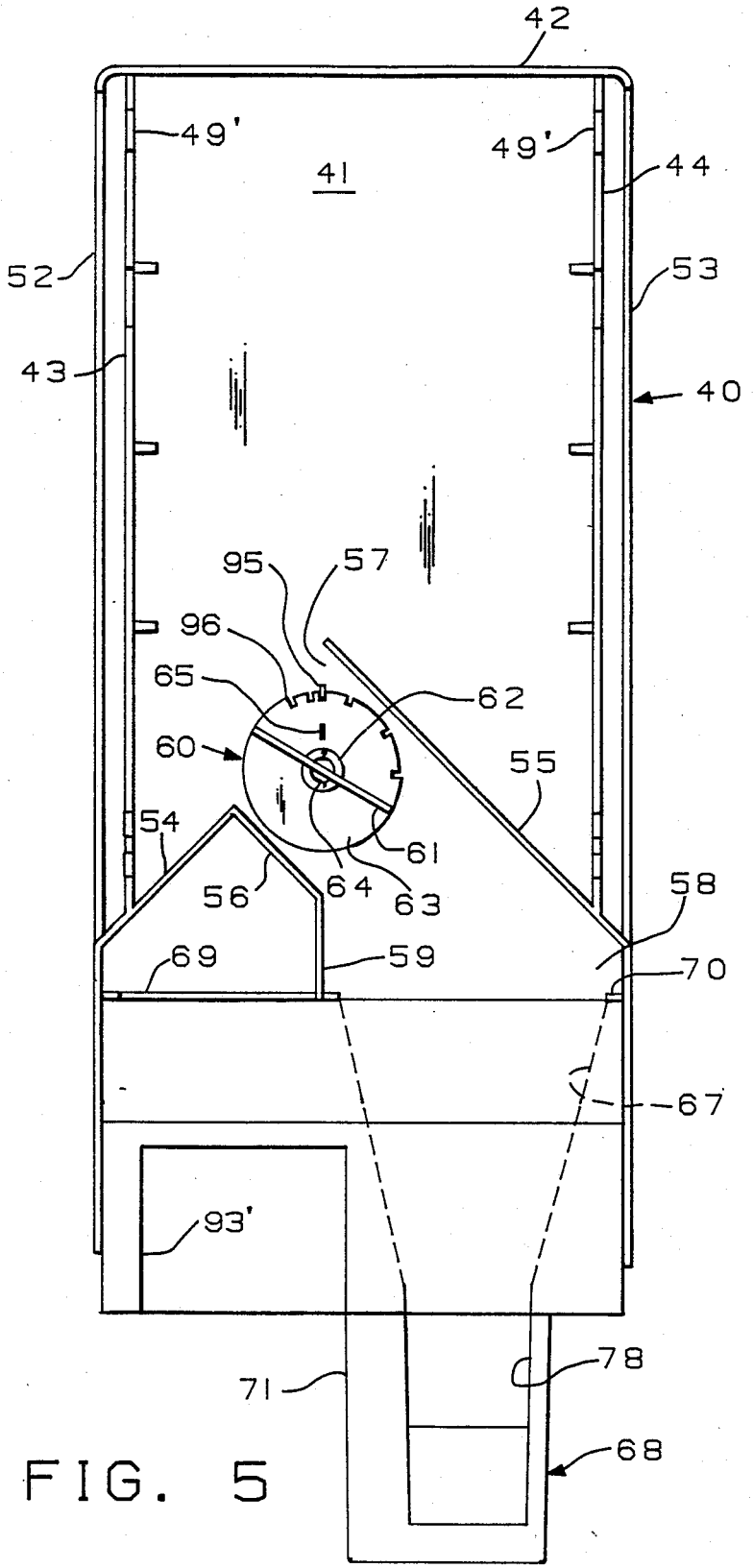
FIG. 5 is a rear elevational view of the duct cover and the block of FIG. 4.

As shown in FIG. 5, the inclined wall 54 extends upwardly from the outer side wall 52 with the bottom of the inner side wall 43 terminating at the inclined wall 54, and the inclined wall 55 extends upwardly from the outer side wall 53 with the bottom of the inner side wall 44 terminating at the inclined wall 55. An inclined wall 56 extends downwardly from the upper end of the inclined wall 54 for a short distance and is substantially parallel to the inclined wall 55.

The inclined wall 55 cooperates with the inclined wall 56 to form a duct 57 therebetween. The duct 57 communicates with the chamber 46 (see FIG. 1) and with a large duct 58 (see FIG. 5), which is formed between a portion of the outer side wall 53 and a wall 59 extending downwardly from the lower end of the inclined wall 56.

A flow control valve 60 controls the rate of air flow from the chamber 46 (see FIG. 1) to the enlarged duct 58. The valve 0 (see FIG. 5) includes a paddle or vane 61, which is supported in a bushing 62 on a disc 63. The disc 63 is rotatably supported on a pivot pin 64 extending rearwardly from the front wall 41 of the duct cover 40.

During assembly, the disc 63 is mounted in the position shown in FIG. 5 through a first key 65, which is vertically disposed above the center of the pivot pin 64, projecting from the front wall 41 of the duct cover 40 into an opening 66 (see FIG. 4) in the disc 63. With the valve 60 in this predetermined position, a predetermined amount of the cooled air flowing through the opening 30 (see FIGS. 2 and 3) from the fan blades 31 (see FIG. 1) is directed into the enlarged duct 58 with the remainder flowing into the freezer compartment 12 through the elongated apertures 45 (see FIG. 4) in each of the top wall 42, the inner side wall 43, and the inner side wall 44 of the duct cover 40.

The enlarged duct 58 communicates with the fresh food compartment 15 (see FIG. 1) through an elongated duct 67 in a block 68 of a suitable thermal insulation plastic material such as STYROFOAM, for example. As shown in FIG. 4, the block 68 fits between the two outer side walls 52 and 53 of the duct cover 40, the front wall 41 of the duct cover 40, and the evaporator cover 24 (see FIG. 2). The front wall 41 (see FIG. 4) of the duct cover 40 has stops 69 and 70 abutting the upper end of the block 68 to control its uppermost position. The block 68 has a portion 71 extending into the fresh food compartment 15 (see FIG. 2) to enable the elongated duct 67 to communicate with the interior of the fresh food compartment 15 to supply the amount of air allowed to flow into the elongated duct 67 from the chamber 46 (see FIG. 1) in accordance with the position of the paddle 61 of the valve 60.

An air diffuser 72, which is a hollow rectangular shaped element, surrounds the extending portion 71 of the block 68 extending from the interior of the freezer liner 14 into the interior of the fresh food compartment 15. The air diffuser 72, which is formed of a suitable plastic material such as ABS, for example, protects the plastic foam material of the block 68 from damage from bottles, for example, within the fresh food compartment 15. The air diffuser 72 has a vertical dividing wall 73 to form ducts 74 and 75 with the duct 74 receiving the extending portion 71 of the block 68.

The air diffuser 72 has an opening 76 (see FIG. 2) in its front wall 77 to enable the elongated duct 67 in the block 68 to communicate with the interior of the fresh food compartment 15 through a duct 78 in the extending portion 71 of the block 68. The air diffuser 72 has an opening 79 in its rear wall 80 to allow the elongated duct 67 to communicate with the interior of the fresh food compartment 15 through the duct 78 in the extending portion 71 of the block 68. The opening 79 is larger than the opening 77 to allow differential air flow for control purposes.

The air diffuser 72 has a peripheral flange 80' on its upper end for support on the top of a hollow rectangular shaped sleeve 81 and extends therethrough. The hollow rectangular shaped sleeve 81 extends through a hollow rectangular shaped sleeve 82. The hollow rectangular shaped sleeves 81 and 82 are injection molded to join each other.

The hollow rectangular shaped sleeve 81 abuts the bottom wall 50 of the freezer liner 14 and a top wall 83 of the fresh food liner 16 for support thereby. The hollow rectangular shaped sleeve 82 has bosses 84 to which each of the horizontal tabs 48 of the inclined forward lower portion 47 of the front wall 41 of the duct cover 40 and the cooperating pocket 48' of the floor 49 are secured by anchor bolts 85.

The sleeve 81 has a slot 86 in its front wall 87 extending upwardly from its bottom edge for only a portion of the front wall 87 so that air flow through the opening 76 in the front wall 77 of the air diffuser 72 is not blocked by the front wall 87 of the sleeve 81. The sleeve 81 has a slot 88 in its rear wall 89 extending upwardly from its bottom edge so as to not block the air flow through the opening 79 in the rear wall 80 of the air diffuser 72.

The duct 75 (see FIG. 3) in the air diffuser 72 functions as a return air duct from the fresh food compartment 15. The duct 75 communicates with the fresh food compartment 15 through three slots 90 in a bottom wall 91 of the air diffuser 72 and three longitudinal slots 92 (see FIG. 11) in a side wall 93 of the air diffuser 72.

The duct 75 (see FIG. 3) in the air diffuser 72 communicates with a return air cavity 93' in the block 68. The evaporator cover 24 has its lower end spaced from the bottom wall 50 of the freezer liner 14 to provide an opening 94 for the return air from the fresh food compartment 15 to flow into the chamber 20. As previously mentioned, the return air from the freezer compartment 12 flows into the chamber 20 on each side of the evaporator cover 24 through the ducts 51A (see FIG. 11).

This return air is drawn over the coils 19 (see FIG. 3) of the evaporator 18 by the fan blades 31 and then discharged as cooled air into the chamber 46. The ratio of the air flow to the freezer compartment 12 and the fresh food compartment 15 is determined by the position of the paddle 61 (see FIG. 5) of the valve 60.

With the paddle 61 in the predetermined position of FIG. 5, a desired ratio of air flow is obtained. With a total of fifty cubic feet of air per minute being supplied from the fan blades 31 (see FIG. 1), only 4.5 cubic feet per minute will flow through the enlarged duct 58 into the fresh food compartment 15 while the remainder will flow into the freezer compartment 12.

If a user complains that the temperature of the freezer compartment 12 is too low or too high, then a service person removes the duct cover 41 (see FIG. 4) and breaks the first key 65 with a pair of pliers, for example. If the freezer compartment 12 (see FIG. 2) is too warm, the disc 63 (see FIG. 4) is pulled away from the front wall 41 of the duct cover 40 so that a second key 95, which is disposed in one of notches 96 in the periphery of the disc 63, is not disposed in any of the notches 96. With the freezer compartment 12 (see FIG. 2) too warm, the disc 63 (see FIG. 5) is rotated counterclockwise to reduce the air flow through the enlarged duct 58 to the fresh food compartment 15 (see FIG. 2) whereby air flow to the freezer compartment 12 is increased.

If the freezer compartment 12 is too cold, the disc 63 (see FIG. 5) is rotated clockwise. This increases the air flow through the enlarged duct 58 to the fresh food compartment 15 (see FIG. 2) while decreasing the air flow to the freezer compartment 12.

The notches 96 (see FIG. 5) are not equally angularly spaced from each other. This is because the relation of the pressure drop to the air flow to the fresh food compartment 15 (see FIG. 2) is not linear. The rate of air flow to the fresh food compartment 15 is determined by which of the notches 96 (see FIG. 5) has the second key 95 therein. The rates of air flow are 2, 3, 4, 4.5, 5, and 7 cubic feed per minute considering the notches 96 in a counterclockwise direction. That is, the second key 95 is shown disposed in the notch 96 corresponding to an air flow of 4.5 cubic feet per minute.

At the time of assembly, the disc 63 is positioned as shown in FIG. 5 in which the first key 65 is disposed in the opening 66 (see FIG. 4) in the disc 63 and the second key 95 is disposed in one of the notches 96. After the disc 63 has been disposed at the new position to change the rate of air flow to the fresh food compartment 15 (see FIG. 2), the disc 63 (see FIG. 5) is pushed towards the front wall 41 of the duct cover 40 until the second key 95 is received in the desired one of the notches 96.

Figure 6:
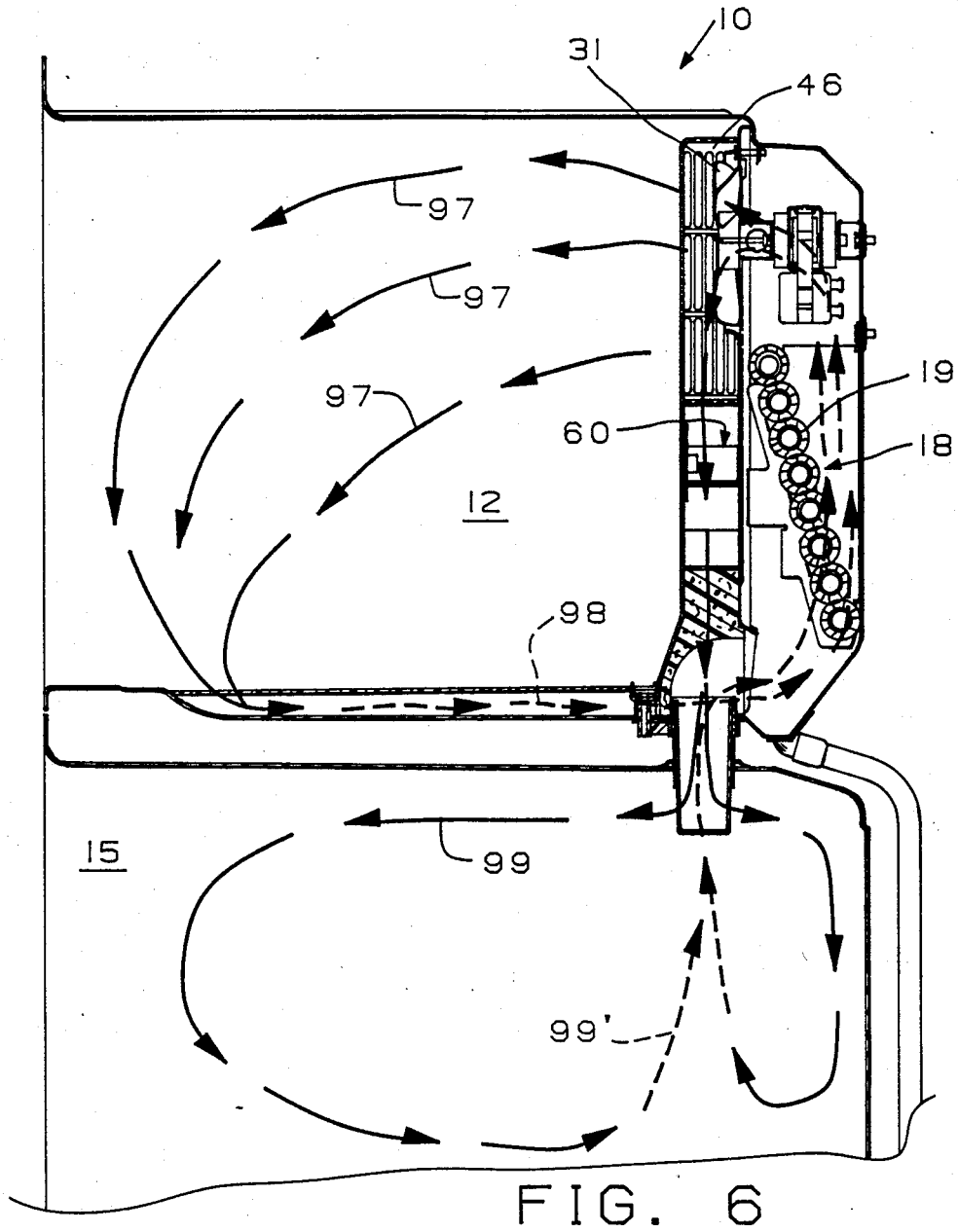
FIG. 6 is a schematic view of a portion of the refrigerator cabinet of FIG. 1 and showing the air flow into both the fresh food compartment and a freezer compartment of the refrigerator cabinet and the return from each.

The air flow over the coils 19 of the evaporator 18 is schematically shown in FIG. 6. The supply air to the freezer compartment 12 is indicated by solid lines 97 and the return air from the freezer compartment 12 is identified by dashed lines 98. The air flow to the fresh food compartment 15 is indicated by solid lines 99 and the return air flow from the fresh food compartment 15 is identified by dashed lines 99'. Thus, all of the return air flows over the coils 19 of the evaporator 18 prior to entering the chamber 46 after discharge thereinto by the fan blades 31.

Figure 7:
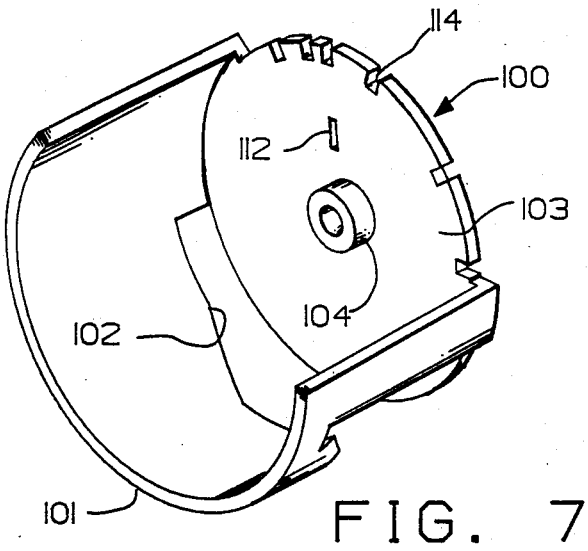
FIG. 7 is a perspective view of another form of air flow control valve of the present invention.

Instead of using the valve 60 (see FIG. 1) to control the rate of air flow to the fresh food compartment 15, a valve 100 (see FIG. 7) may be utilized. The valve 100 includes an arcuate portion 101 having an opening 102 of varying size therein.

A disc 103 is secured to the arcuate portion 101 adjacent one side of the opening 102. The disc 103 has a bushing 104 mounted thereon to receive a pivot pin 105 (see FIG. 8) extending from a front wall 106 of a duct cover 107. The duct cover 107 is the same as the duct cover 40 (see FIG. 4) except for a duct 108 (see FIG. 8), which is formed between a pair of parallel walls 109 and 110 of the duct cover 107.

The front wall 106 of the duct cover 107 has a first key 111, which is frangible, extending through an opening 112 (see FIG. 7) in the disc 103. The valve 100 is disposed with the opening 112 receiving the first key 111 (see FIG. 8) during assembly to insure a predetermined rate of flow of air into the duct 108.

The front wall 106 has a second key 113, which is in vertical alignment with the first key 111 and the center of the pivot pin 105, extending therefrom for disposition in one of a plurality of notches 114 in the periphery of the disc 103. The notches 114 are spaced from each other with the same spacing as the notches 96 (see FIG. 5) in the periphery of the disc 63 of the valve 60.

Whenever it is necessary to change the rate of air flow to the duct 108 (see FIG. 8) because of a complaint from a user, the first key 111 is broken in the same manner as the first key 65 (see FIG. 5). After the valve 100 (see FIG. 8) is pulled away from the front wall 106 of the duct 107 so that the second key 113 is not in any of the notches 114, the disc 103 is rotated in the desired direction to change the flow rate to the duct 108 in the same manner as discussed with respect to the valve 60 (see FIG. 4). After the valve 100 (see FIG. 8) is rotated about the pivot pin 105 to a desired position, the disc 103 is again pushed against the front wall 106 of the duct cover 107 with the second key 113 disposed in another of the notches 114 than that shown in FIG. 8.

Figure 8:
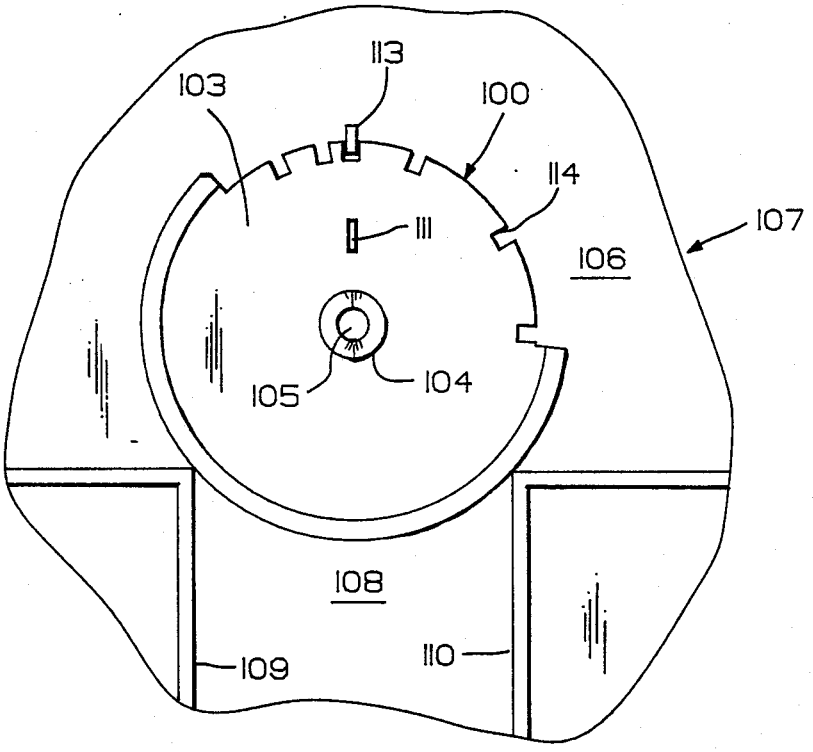
FIG. 8 is a fragmentary rear elevational view of a portion of a duct cover supporting the valve of FIG. 7.

The upper ends of the walls 109 and 110 cooperate with the opening 102 (see FIG. 7) in the arcuate portion 101 of the valve 100 to control the rate of air flow to the duct 108 (see FIG. 8). The opening 102 (see FIG. 7) is shaped to provide the desired area for the desired rate of air flow to the duct 108 (see FIG. 8) at the different positions of the valve 100. The supply of cooled air from the duct 108 to the fresh food compartment 12 (see FIG. 1) may be accomplished by any suitable means including the utilization of a duct such as the duct 67 in the block 68, for example.

An advantage of this invention is that the control valve is located at a predetermined position during assembly to provide what is considered the desired rate of air flow to the fresh food and freezer compartments. Another advantage of this invention is that any adjustment of the air flow control valve for controlling the rate of air flow to the fresh food compartment is by a trained service person rather than a user.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. A refrigerator cabinet including:
- a fresh food compartment;
- a freezer compartment;
- an evaporator mounted in said freezer compartment;
- an evaporator cover mounted in said freezer compartment forward of said evaporator;
- a duct cover mounted in said freezer compartment, said duct cover being spaced from said evaporator cover and forwardly thereof;
- a chamber formed between said duct cover and said evaporator cover;
- duct means for communicating said chamber with said fresh food compartment;
- said duct cover having communicating means for communicating said chamber with said freezer compartment;
- fan means for circulating air from said fresh food compartment and said freezer compartment over said evaporator and from said fan means through said chamber to said fresh food compartment and said freezer compartment;
- valve means rotatably supported by said duct cover and controlling the air flow into said duct means from said chamber;
- said duct cover and said valve means having first cooperating means to dispose said valve means in a predetermined position;
- and said duct cover and said valve means having second cooperating means to dispose said valve means at one of a plurality of selected positions in accordance with the desired air flow after said first cooperating means is rendered permanently ineffective.

2. The refrigerator cabinet according to claim 1 in which:
- said first cooperating means of said duct cover includes a frangible member;
- said first cooperating means of said valve means includes receiving means for receiving said frangible member to retain said valve means in the predetermined position until said frangible member is broken.

3. The refrigerator cabinet according to claim 2 in which:
- said duct cover includes a front wall forming a wall of said chamber;
- said second cooperating means of said valve means includes:
  - a disc rotatably mounted on said front wall of said duct cover;
  - and a plurality of spaced notches on the periphery of said disc, said notches being spaced in accordance with various rates of air flow from said chamber into said fresh food compartment;
  - and said second cooperating means of said duct cover includes projecting means extending from said front wall of said duct cover for disposition in one of said notches in the periphery of said disc to retain said valve means in one of its selected positions.

4. The refrigerator cabinet according to claim 3 including:
- a block of thermal insulation material extending from said freezer compartment into said fresh food compartment;
- said duct means including:
  - a first duct communicating with said chamber;
  - and a second duct within said block communicating said first duct with said fresh food compartment;
- and said valve means including flow control means cooperating with said first duct to control the air flow therethrough.

5. The refrigerator cabinet according to claim 4 in which:
- said duct cover includes:
  - a side wall extending from each side of said front wall and engaging said evaporator cover;
  - a top wall extending from the top of said front wall and engaging said evaporator cover;
  - and said side walls, said top wall, said front wall, and said evaporator cover forming walls of said chamber;
- and said communicating means includes openings in each of said side walls and said top wall of said duct cover.

6. The refrigerator cabinet according to claim 5 in which:

said freezer compartment includes a plurality of walls;

a cooling chamber is formed between at least some of said walls of said freezer compartment and said evaporator cover;

said cooling chamber has said evaporator mounted therein;

said evaporator cover has an opening providing communication between said cooling chamber and said chamber;

and said fan means circulates air through said opening in said evaporator cover from said cooling chamber to said chamber.

7. The refrigerator cabinet according to claim 4 in which said flow control means of said valve means is disposed within said first duct.

8. The refrigerator cabinet according to claim 7 in which:

said duct cover includes:

a side wall extending from each side of said front wall and engaging said evaporator cover;

a top wall extending from the top of said front wall and engaging said evaporator cover;

and said side walls, said top wall, said front wall, and said evaporator cover forming walls of said chamber;

and said communicating means includes openings in each of said side walls and said top wall of said duct cover.

9. The refrigerator cabinet according to claim 6 in which:

said freezer compartment includes a plurality of walls;

a cooling chamber is formed between at least some of said walls of said freezer compartment and said evaporator cover;

said cooling chamber has said evaporator mounted therein;

said evaporator cover has an opening providing communication between said cooling chamber and said chamber;

and said fan means circulates air through said opening in said evaporator cover from said cooling chamber to said chamber.

10. The refrigerator cabinet according to claim 3 in which:

said duct cover includes:

a side wall extending from each side of said front wall and engaging said evaporator cover;

a top wall extending from the top of said front wall and engaging said evaporator cover;

and said side walls, said top wall, said front wall, and said evaporator cover forming walls of said chamber;

and said communicating means includes openings in each of said side walls and said top wall of said duct cover.

11. The refrigerator cabinet according to claim 2 including:

a block of thermal insulation material extending from said freezer compartment into said fresh food compartment;

said duct means including: a first duct communicating with said chamber; and a second duct within said block communicating said first duct with said fresh food compartment;

and said valve means including flow control means cooperating with said first duct to control the air flow therethrough.

12. The refrigerator cabinet according to claim 11 in which said flow control means of said valve means is disposed within said first duct.

13. The refrigerator cabinet according to claim 12 in which: said duct cover includes:

a front wall;

a side wall extending from each side of said front wall and engaging said evaporator cover;

a top wall extending from the top of said front wall and engaging said evaporator cover;

and said side walls, said top wall, said front wall, and said evaporator cover forming walls of said chamber;

and said communicating means includes openings in each of said side walls and said top wall of said duct cover.

14. The refrigerator cabinet according to claim 11 in which:

said duct cover includes:

a front wall;

a side wall extending from each side of said front wall and engaging said evaporator cover;

a top wall extending from the top of said front wall and engaging said evaporator cover;

and said side walls, said top wall, said front wall, and said evaporator cover forming walls of said chamber;

and said communicating means includes openings in each of said side walls and said top wall of said duct cover.

15. The refrigerator cabinet according to claim 2 in which:

said duct cover includes:

a front wall;

a side wall extending from said side of said front wall and engaging said evaporator cover;

a top wall extending from the top of said front wall and engaging said evaporator cover;

and said side walls, said top wall, said front wall, and said evaporator cover forming walls of said chamber;

and said communicating means includes openings in each of said side walls and said top wall of said duct cover.

16. The refrigerator cabinet according to claim 1 in which:

said duct cover includes a front wall forming a wall of said chamber;

said second cooperating means of said valve means includes:

a disc rotatably mounted on said front wall of said duct cover;

and a plurality of spaced notches on the periphery of said disc, said notches being spaced in accordance with various rates of air flow from said chamber into said fresh food compartment;

and said second cooperating means of said duct cover includes projecting means extending from said front wall of said duct cover for disposition in one of said notches in the periphery of said disc to retain said valve means in one of its selected positions.

17. The refrigerator cabinet according to claim 16 including:

a block of thermal insulation material extending from said freezer compartment to said fresh food compartment;

said duct means including:

a first duct communicating with said chamber;

and a second duct within said block communicating said first duct with said fresh food compartment;

and said valve means including flow control means cooperating with said first duct to control the air flow therethrough.

18. The refrigerator cabinet according to claim 17 in which said flow control means of said valve means is disposed within said first duct.

19. The refrigerator cabinet according to claim 1 including:

a block of thermal insulation material extending from said freezer compartment to said fresh food compartment;

said duct means including: a first duct communicating with said chamber; and a second duct within said block communicating said first duct with said fresh food compartment;

and said valve means including flow control means cooperating with said first duct to control the air flow therethrough.

20. The refrigerator cabinet according to claim 19 in which said flow control means of said valve means is disposed within said first duct.

* * * * *

UNITED STATES PATENT AND TRADEMARK OFFICE

CERTIFICATE OF CORRECTION

PATENT NO. : 4,920,765

DATED : May 1, 1990

INVENTOR(S) : Michael J. McCauley, David G. Beers and John P. Raymond

It is certified that error appears in the above-identified patent and that said Letters Patent is hereby corrected as shown below:

Col. 8, line 17, before "said" (1th occurrence) insert the word

--and--.

Signed and Sealed this

Sixteenth Day of July, 1991

*Attest:*

HARRY F. MANBECK, JR.

*Attesting Officer*

*Commissioner of Patents and Trademarks*